United States Patent [19]

Erbstoesser et al.

[11] 4,195,690

[45] Apr. 1, 1980

[54] METHOD FOR PLACING BALL SEALERS ONTO CASING PERFORATIONS

[75] Inventors: Steven R. Erbstoesser; Christopher M. Shaughnessy, both of Houston, Tex.

[73] Assignee: Exxon Production Research Company, Houston, Tex.

[21] Appl. No.: 933,305

[22] Filed: Aug. 14, 1978

Related U.S. Application Data

[63] Continuation-in-part of Ser. No. 850,878, Nov. 14, 1977, abandoned.

[51] Int. Cl.[2] ..... E21B 33/13; E21B 43/26; E21B 43/27

[52] U.S. Cl. ..... 166/281; 166/284

[58] Field of Search ..... 166/284, 269, 281

[56] References Cited

U.S. PATENT DOCUMENTS

| | | | |
|---|---|---|---|
| 2,754,910 | 7/1956 | Derrick et al. | 166/284 |
| 2,933,136 | 4/1960 | Ayers et al. | 166/284 |
| 3,011,548 | 12/1961 | Holt | 166/284 |
| 3,174,546 | 3/1965 | Flickinger | 166/269 |
| 3,292,700 | 12/1966 | Berry | 166/284 |
| 3,376,934 | 4/1968 | Willman et al. | 166/284 X |
| 3,437,147 | 4/1969 | Davies | 166/284 |
| 3,547,197 | 12/1970 | Chevalier et al. | 166/284 |
| 3,595,314 | 7/1971 | Garner | 166/192 |
| 3,715,055 | 2/1973 | Kendrick et al. | 221/75 |
| 3,895,678 | 7/1975 | Wright et al. | 166/284 |

*Primary Examiner*—Stephen J. Novosad

*Attorney, Agent, or Firm*—Gary D. Lawson; Robert B. Martin

[57] ABSTRACT

A method is disclosed for transporting ball sealers down a perforated casing of a well to affect fluid diversion when hydraulically treating a formation penetrated by the well. In this invention, ball sealers are transported to said perforations in a carrier fluid system comprising a leading fluid portion having a density greater than said ball sealers and a trailing fluid portion having a density less than said ball sealers. The ball sealers will be moved downwardly in the casing to the perforations and will seat onto the perforations through which fluids are flowing to divert fluid through the unplugged perforations.

20 Claims, 3 Drawing Figures

METHOD FOR PLACING BALL SEALERS ONTO CASING PERFORATIONS

CROSS-REFERENCE TO RELATED APPLICATIONS

This application is a Continuation-in-Part of Application Ser. No. 850,878; filed Nov. 14, 1977, now abandoned.

BACKGROUND OF THE INVENTION

1. Field of the Invention

This invention pertains to the treating of wells, and more particularly to a method for selectively restricting the flow of fluids through performations in an oil well casing by small balls or spheres of appropriate size.

2. Description of the Prior Art

It is a common practice in completing oil and gas wells to set a string of pipe, known as casing, in the well and use cement around the outside of the casing to isolate the various hydrocarbon productive formations penetrated by the well. To establish fluid communication between the hydrocarbon bearing formations and the interior of the casing, the casing and cement sheath are perforated.

At various times during the life of the well, it may be desirable to increase the production rate of hydrocarbons by acid treatment or hydraulic fracturing. If only a short, single, hydrocarbon-bearing zone in the well has been perforated, the treating fluid will flow into this productive zone. As the length of the perforated zone or the number of perforated zones increases, treatment of the entire productive zone or zones becomes more difficult. For instance, the strata having the highest permeability will most likely consume the major portion of a given stimulation treatment leaving the least permeable strate virtually untreated. Therefore, techniques have been developed to divert the treating fluid from the high permeability zones to the low permeability zones.

Various techniques for selectively treating multiple zones have been suggested including techniques using packers, baffles and balls, bridge plugs, and ball sealers.

Packers have been used extensively for separating zones for treatment. Although these devices are effective, they are expensive to use because of the associated workover equipment required during the tubing packer manipulations. Moreover, mechanical reliability tends to decrease as the depth of the well increases.

In using baffles and balls to separate zones, a baffle ring, which has a slightly smaller inside diameter than the casing, fits between two joints of casing so that a large ball, or bomb, dropped in the casing will seat in the baffle. After the ball is seated in the baffle, the ball prevents further fluid flow down the hole. One disadvantage with this method is that the baffles must be run with the casing string. Moreover, if two or more baffles are used, the inside diameter of the bottom baffle may be so small that a standard perforating gun cannot be used to perforate below the bottom baffle.

A bridge plug, which is comprised principally of slips, a plug mandrel, and a rubber sealing element, has been run and set in casing to isolate a lower zone while treating an upper section. After fracturing or acidizing the well, the plug is generally retrieved, drilled, or knocked to the well bottom with a chisel bailer. One difficulty with the bridge plug method is that the plug sometimes does not withstand high differential pressures. Another problem with this technique is that the placement and removal of the plug can be expensive due to associated rig costs.

One of the more popular and widely used diverting techniques uses ball sealers. In a typical method, ball sealers are pumped into the well along with formation treating fluid. The balls are carried down the wellbore and to the perforations by the fluid flow through the perforations. The balls seat upon the perforations and are held there by the pressure differential across the perforations.

Although ball sealer diverting techniques have met with considerable usage, the balls often do not perform effectively because only a fraction of the balls injected actually seat on perforations. Ball sealers having a density greater than the treating fluid will often yield a low and unpredictable seating efficiency, highly dependent on the difference in density between the ball sealers and the fluid, the flow rate of the fluid through the perforations, and the number, spacing and orientation of the perforations. The net result is that the plugging of the desired number of perforations at the proper time during the treatment to effect the desired diversion is left completely to chance.

Lightweight ball sealers are ball sealers having a density less than the treating fluid density and have been proposed to improve upon this seating efficiency problem. The treating fluid containing lightweight ball sealers is injected down the well at a rate such that the downward velocity of the fluid is sufficient to impart a downward drag force on the ball sealers greater in magnitude than the upward buoyancy force of the ball sealers. Once the ball sealers have reached the perforations, they all will seat and plug the perforations provided fewer balls are injected than there are perforations accepting fluid, thereby forcing the treating fluid to be diverted to the remaining open perforations. Although these lightweight ball sealers can be highly effective in improving diversion, one problem with using these ball sealers occurs when the downward flow of fluid in the casing is so slow, that the drag forces exerted on the balls by the treating fluid may not overcome the upward buoyancy force of the ball sealers and thus the ball sealers may not be transported to the perforations. This problem is generally experienced during treatments pumped at low rates and in particular matrix treatments such as matrix acidizing.

SUMMARY OF THE INVENTION

The present invention is intended to overcome the shortcomings of the various prior art techniques for using ball sealers to divert fluid between perforations in a cased wellbore. Broadly, the invention comprises transporting ball sealers to casing perforations in a carrier fluid system which comprises a leading fluid portion having a density greater than said ball sealers density and a trailing fluid portion having a density no greater than said ball sealers density.

One embodiment of this invention involves the injection into the casing of ball sealers, a dense fluid having a density greater than the balls, and a light fluid having a density less than the balls. The light fluid is introduced into the casing following the dense fluid. The ball sealers are introduced anytime after the initiation of injection of the dense fluid (including during the injection of the light fluid) prior to introduction of any additional dense fluids. Once the ball sealers, the light fluid, and the dense fluid are in the casing, the fluids are displaced down the casing and through the perforations not plugged by the ball sealers. Because the ball sealers sink in the light fluid and float in the dense fluid, the balls are transported down the casing to the perforations. The treating fluid can have any density; however, if the treating fluid is more dense than the ball sealers, it is preferred that at least a portion of the treating fluid be introduced into the casing above the lighter fluid and thereby displacing the light fluid, the ball sealers, and the dense fluid down the casing. By this method the treating fluid will be forced into those perforations not plugged by the ball sealers.

In another embodiment of this invention, a first fluid containing ball sealers having a density less than the first fluid is injected downwardly in the casing. The downward flow rate of the first fluid is sufficient to impart a downward drag force on the ball sealers greater in magnitude than the upward buoyancy force of the ball sealers. A sufficient amount of first fluid is injected such that substantially all the ball sealers are transported to and seated on the perforations by the first fluid. After introduction of the first fluid, a second fluid less dense than the ball sealers is injected into the casing. Once the balls reach the perforations, they will seat on perforations taking fluid, plug the perforations and cause the second fluid and any remaining first fluid to flow through the remaining open perforations. Preferably the dense, first fluid is the formation treating fluid.

The present invention provides an improved method for downwardly transporting ball sealers in the casing to achieve high seating efficiency of the ball sealers onto the casing perforations. This method is particularly applicable when the injection of treating fluid into the formation is at very low rates, such as during matrix treating, and the ball sealers have a density less than the treating fluid density.

DESCRIPTION OF THE PREFERRED EMBODIMENTS

Figure 1:
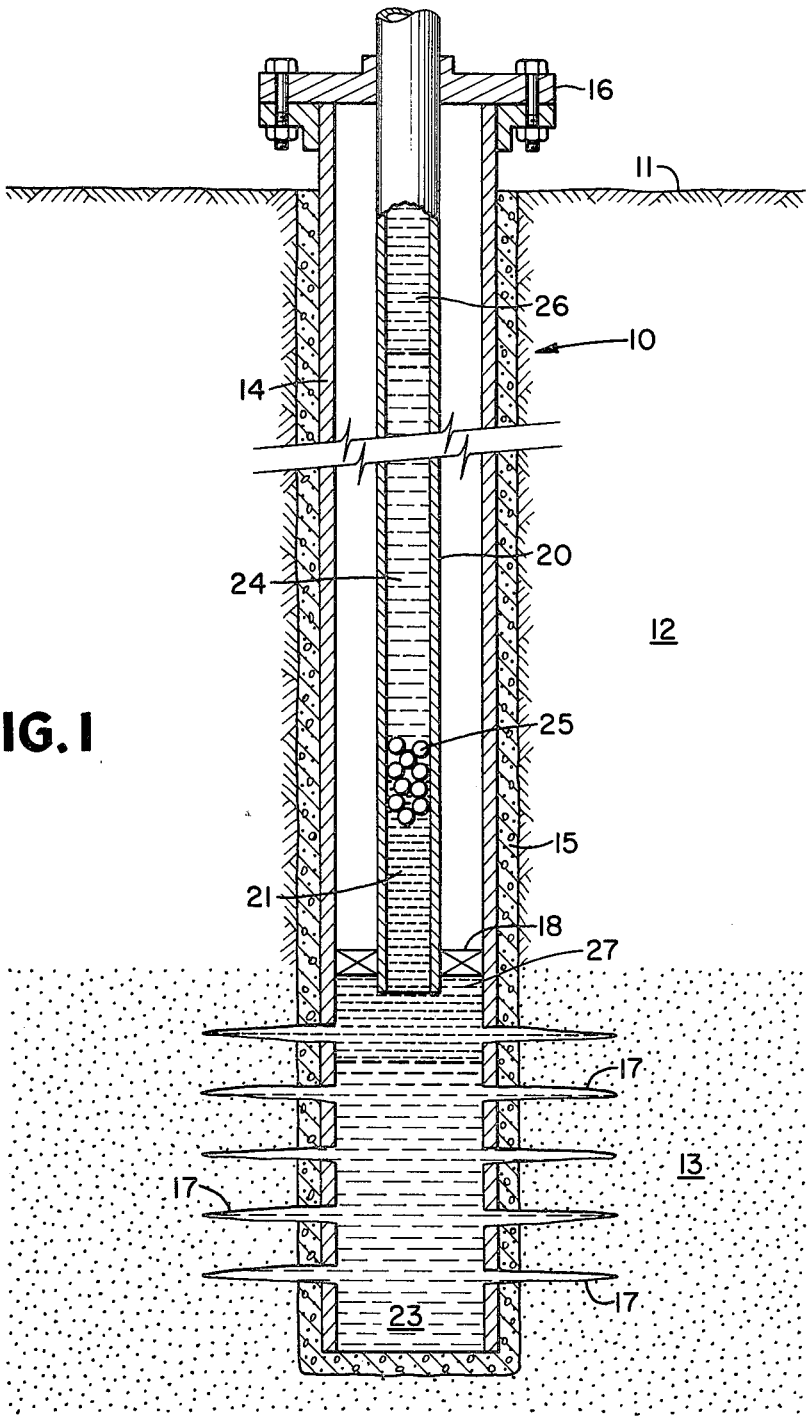
FIG. 1 is an illustration view in section of a well illustrating one embodiment of the present invention.

Referring to FIG. 1, there is shown a wellbore, indicated generally by the numeral 10, which extends from the earth's surface 11 through an overburden 12 to a subterranean formation 13 which contains petroleum, gas and mixtures thereof. A string of casing 14 extends from the earth's surface 11 to the bottom of the wellbore 10. The space between the casing 14 and the wall of the wellbore is filled with cement 15. The cement 15 extends as illustrated from the bottom of the wellbore 10 to earth's surface 11. The casing 14 is capped by a suitable wellhead 16 to which is coupled a suitable flowline. The casing and the surrounding cement sheath are provided with a plurality of perforations 17 penetrating the formation 13. The well may be provided with a suitable packer 18 which isolates the production from formation 13 from the remainder of the well using a tubing string 20 which extends from the wellhead 16 through packer 18. The tubing string is provided with a suitable flowline (not shown) for the introduction and withdrawal of fluids to and from the well.

If the well does not have the desired productivity, it is common practice to treat the well to improve the well's production characteristics. This may be accomplished by acidizing, hydraulic fracturing or other methods which comprise forcing a treating material down the casing and into the producing formation through the perforations 17 in the casing. As mentioned above, it is sometimes desirable to selectively close those perforations through which fluid is flowing during the treating operation so that treating fluid is forced into the formation adjacent to other perforations in the casing.

Prior to illustrating any specific embodiments of this invention, it is appropriate that the following definitions be established to clarify the relative terminology used to describe ball sealer and fluid density characteristics. Namely, light or low density fluids refer to fluids having density less than the ball sealer density. Neutral density fluids refer to fluids having a density essentially equal to the density of the ball sealer density. Conversely, dense or heavy fluids herein refer to fluids having density greater than the ball sealer density. Similarly, light, lightweight, or low density ball sealers refer to ball sealers having density less than the wellbore fluid density. While heavy or dense ball sealers refer to ball sealers having density greater than the wellbore treating fluid density.

By way of illustrating one embodiment of the present invention, it will be assumed that the well is an oil production well which is to be treated by a matrix acidizing operation to increase the permeability of formation 13 near the wellbore. It is to be understood, however, that the following description of such an acidizing operation is merely exemplary in that the invention may be used in other well treating procedures, such as hydraulic fracturing or solvent surfactant stimulation treatments.

The acidizing of formation 13 is accomplished by first pumping through production tubing 20 a dense liquid 23 to fill the lower portion of the well at least up to a level adjacent the lower perforations to be plugged with ball sealers. After a suitable quantity of dense liquid 23 has been introduced into the well, a second dense fluid 21 containing the ball sealers 25 is pumped into the casing through the producing tubing 20. In the preferred embodiment of this invention, the second dense fluid 21 would be the treating fluid. After a suitable quantity of dense fluid 21 is injected, a light, third fluid 24 is introduced into the casing through the production tubing 20. Ball sealers 25 are also contained within this light fluid 24. Because the ball sealers are heavier than the light fluid 24 and lighter than the dense fluids 23 and 21, the balls will gravitate to the bottom of light fluid 24 and float at the top of dense fluid 21.

The light fluid 24 and dense fluid 21 may mix during flow down the well to form a zone having a density intermediate to the densities of the light and dense fluids. The ball sealers will tend to migrate to that region of mixing where the fluid density is equal to the ball density.

A sufficient amount of light fluid 24 should be pumped into the well such that the ball sealers below, or contained within, the light fluid 24 will travel with the light fluid 24 as the light fluid is displaced down the casing to the perforations. If the light fluid 24 is the treating fluid, continued injection of light fluid 24 will transport the ball sealers down the casing and many of the balls may seat onto the perforations in the presence of the light fluid. If the treating fluid is a dense fluid, it is preferred that after sufficient amount of light fluid 24 has been introduced into the casing, a displacement fluid, identified in the FIG. 1 by numeral 26, be injected into the casing to displace the previously injected fluids and the ball sealers to the perforations 17.

The dense fluid 21 is introduced into the well ahead of the light fluid and may be referred to as the leading fluid. Similarly, the light fluid 24 may be referred to as the trailing fluid. Included in these two classes of fluids (i.e. dense fluids and light fluids) are any fluids with the requisite density characteristics.

Suitable dense fluid 23 may include aqueous fluids such as calcium chloride and sodium chloride solutions and non-aqueous fluids such as ortho-nitrotoluene, carbon disulfide, dimethylpthalate, nitrobenzene and isoquinoline. The purpose of introducing the dense fluid 23 into the well is to insure that the fluid in the well below the perforations to be sealed has a density greater than the ball sealer density. The ball sealers will thus float on the dense fluid and will not sink to the portion of the well below the lowest perforation taking fluid, i.e. the rathole.

Dense treating fluids 21 may include any treating liquid with the requisite density characteristics. Suitable fluids may include acid solutions such as hydrochloric acid, hydrofluoric acid, formic acid, salt weighted acid solutions, as well as suitable dense hydraulic fracturing fluids and surfactant solutions used to stimulate the formation.

The light fluid 24 introduced into the casing may include any fluid having the requisite density characteristics. Suitable light fluids include field crudes, diesel oil, aromatic solvents, light hydrocarbon condensates, low salinity brines and fresh water. The light fluid 24 may be either miscible or immiscible with the dense fluids 23 and 21. However, the light fluid is preferably miscible with the displacing fluid 26 and immiscible with dense fluid 21.

The minimum volume of light fluid 24 introduced in the casing according to this invention will vary depending on the miscibility of the light fluid 24 with dense fluid 21 and displacing fluid 26, the distance the light fluid will carry the ball sealers, the number of ball sealers to be transported down the casing and the density differential between the light fluid and the ball sealers. If the production tubing 20 extends beneath the packer 18, (as shown in FIG. 1) a sufficient quantity of light fluid 24 should be injected into tubing 20 to fill the annular space 24 between the portion of the tubing below the packer and the casing 14 with light fluid 24. It is desirable to inject sufficient light fluid to fill annular space 27 to prevent trapping of ball sealers at an interface between light fluid 24 and the more dense fluids 23 or 21 at a level between the bottom of tubing 20 and the base of the packer 18.

Preferably, both fluids 21 and 24 are formation treating fluids and the ball sealers have a density greater than the resident formation fluids. After a suitable amount of the light fluid 24 has been injected into the formation, fluid injection may be stopped to permit pressure in the well to decrease. The ball sealers which unseat from the perforation will tend to gravitate to the bottom of the light fluid and thus be less likely to be produced from the well during production of formation fluids, particularly if the production fluids are low density fluids. The balls which sink to the bottom of the well may be used again to plug perforations in the casing by injecting into the casing additional dense fluid. The dense fluid will cause the ball sealers to float upwards toward the perforations where they may seat and again divert the fluid flow.

The ball sealers used in the practice of this invention should have a density between the light fluid 24 and dense fluids 23 and 21. Ball sealers suitable for this invention may have an outer covering sufficiently compliant to conform to the perforations and have a solid rigid core which resists extrusion into or through the perforations. The ball sealers are approximately spherical in shape but other geometries may be used. The density differential between the light fluid 24 and the ball sealers is preferably sufficient to allow the ball sealers to gravitate to the bottom of the light fluid as the light fluid flows downwardly in the casing. In a typical matrix treating process, the density differential between the light fluid 24 and the ball sealers is preferably about 0.03 g/cc or more at bottom-hole conditions. Similarly, the density differential between the dense fluid 21 and the ball sealers is preferably about 0.03 g/cc or more at bottom-hole conditions. For example, if the density of ball sealers is 1.00 g/cc, the dense fluid 21 should have a density of at least 1.03 g/cc and the light fluid 24 should have a density less than 0.97 g/cc at bottom-hole conditions. To achieve this controlled density situation according to this invention, the ball sealers may be constructed specifically to yield the appropriate densities. Alternatively, a suitable ball sealer, preferably having a density between 0.95 and 1.10 g/cc, may be selected and suitable fluids 21, 23, 24, and 26 having appropriate densities at the bottom-hole conditions may then be selected.

During treatment, the ball sealers used in this invention will not remain below the lowest perforation through which the treating fluid is flowing, due to the buoyancy of the ball sealers. At least a portion of dense fluid 23 first introduced in the casing gravitates to a position below the lowest perforation through which the treating fluid is flowing. Placement of dense fluid 23 in the rathole is facilitated by using a dense fluid which is immiscible with any wellbore fluid present in the rathole. Upon introduction of the dense fluid 23 in the casing below the packer 18, pumping is preferably stopped to promote the immiscible displacement from the rathole of any lighter fluids in the rathole. The dense fluid 23 below the lowest perforations accepting treating fluid remains stagnant; therefore, there are no downwardly directed drag forces acting on the ball sealers to overcome the buoyancy force of the ball sealers to keep them below the lowest perforations taking the injected fluid.

Ball sealers injected into casing in accordance with this invention will plug the perforations through which the dense fluids are flowing with 100% efficiency. Each and every ball sealer will seat and plug a perforation provided there is a perforation through which the dense fluid is flowing and that flow is sufficient to maintain the balls within the perforated interval.

The embodiment described above may be repeated to carry out multistage treatments of the formation. For example, the process may be repeated by using a treating fluid as a displacing fluid 26. The treating fluid would be followed by light fluids and ball sealers as described above.

In another embodiment of this invention a subterranean formation penetrated by a well is treated by introducing into the well ball sealers, a treating fluid having a density greater than the density of the ball sealers, and a neutral density fluid having a density essentially the same as the density of the ball sealers. The neutral density fluid is introduced into the casing following the dense fluid and the ball sealers are introduced anytime following the initiation of the dense fluid injection (including during the injection of the neutrally dense fluid) and prior to introduction of any additional dense fluids. Ball sealers are transported down the casing to the perforations by the neutral density fluid. It is important in the practice of this embodiment to select fluids and balls which will have essentially the same density throughout the range of temperatures and pressures encountered during transport of the ball sealers to the perforations. If the ball sealers become less dense than the "neutral" density fluid, transport of the ball sealers to the perforation will be dependent on the fluid flow velocity and the density contrast.

Figure 2:
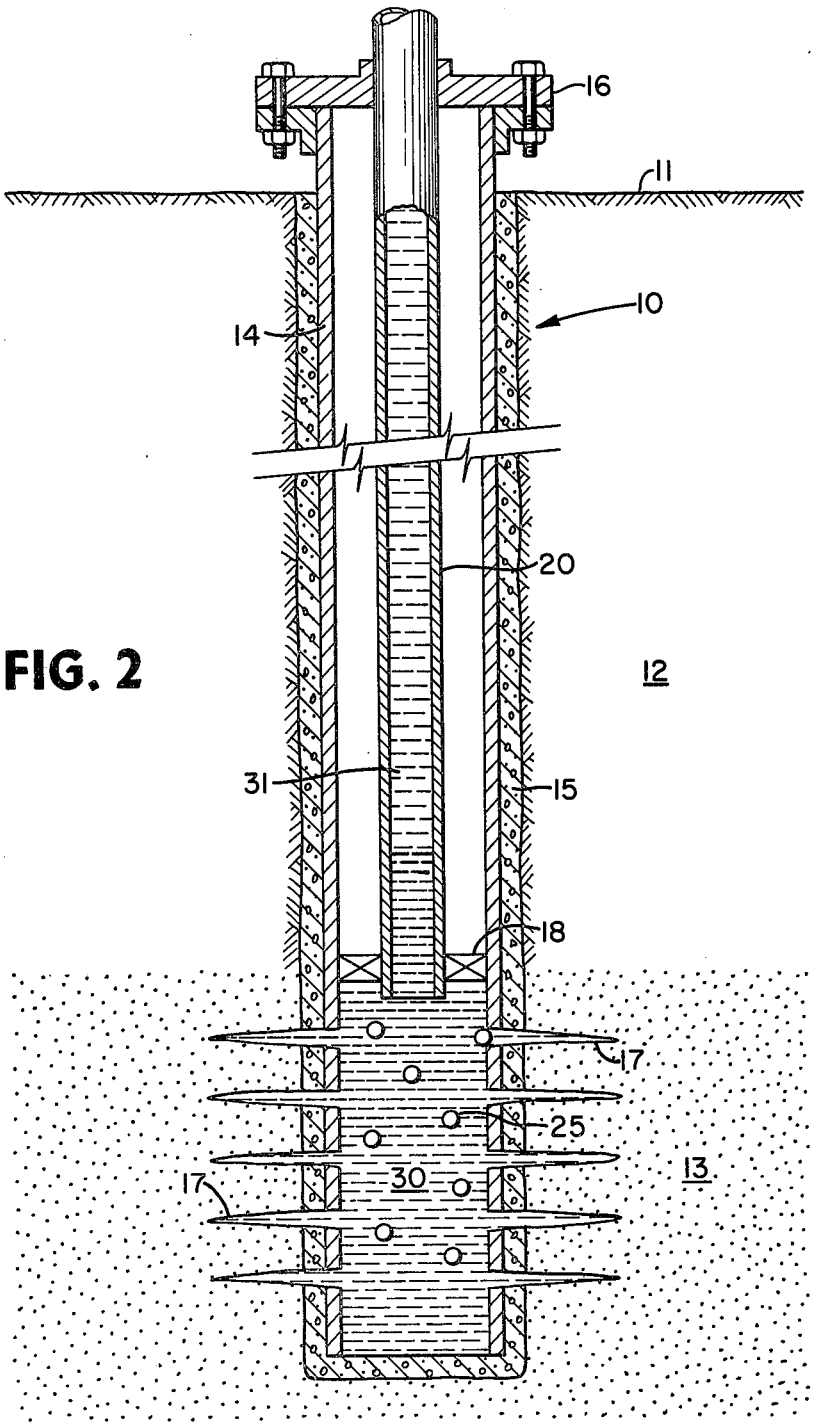
FIG. 2 is an illustration view in section of a well illustrating another embodiment of this invention.

Still another another embodiment of this invention will be described with reference to FIGS. 2 and 3. FIG. 2 shows a well completed substantially the same as described in FIG. 1 and further shows a dense fluid 30 containing ball sealers 25 being injected down casing 14 through perforations 17. Preferably, the first fluid 30 is a formation treating fluid. The light, second fluid 31 is injected into the casing and caused to flow down tubing 20 to displace the dense fluid 30 into the formation through perforations which remain open to fluid flow.

The dense fluid 30 is injected into the casing to carry the ball sealers downwardly to the perforations and to seat the balls onto perforations taking fluids. A sufficient amount of the first fluid should be injected to insure that essentially all the ball sealers have seated onto the perforations and the formation treatment has been concluded before the ball sealers are contacted by the light, second fluid. This is because it is the flow of the dense fluid which seats the ball sealers onto the perforations with 100% seating efficiency. The dense fluid carrying the ball sealers should be injected down the casing at a rate sufficient to overcome the buoyancy of the ball sealers. Should the dense fluid flow down the casing at a slow rate, such as may occur during matrix acidization treatments, the dense fluid may contain viscosity increasing agents to increase the drag on the ball sealers as the dense fluid 30 flows down the well.

Once a sufficient amount of the dense fluid 30 has been introduced into the casing, the light 31 is injected into the casing. The light fluid displaces the dense fluid 30 into the formation and through the perforations that remain unplugged.

After displacing the light fluid 31 at least to the perforations and preferably into the formation, injection is stopped and the pressure in the casing is allowed to decrease. If the downhole pressure in the casing is allowed to decrease to and preferably below the formation pressure, the ball sealers will unseat from the perforations and will sink to the bottom of light fluid 31 (as shown in FIG. 3). FIG. 3 shows the balls in the rathole after the balls have unseated from the perforations and have sunk to the bottom of light fluid 31. The well may be placed on production and the balls will be more likely to remain in the rathole if the balls are adjacent to or below the lowest perforation through which fluids are being produced. The balls will be most likely to remain in the rathole if the ball sealers are more dense than the produced formation fluids.

The balls in the rathole, as shown in FIG. 3, may be used again for fluid diversion, provided a dense fluid is again introduced into the wellbore and displaced to the rathole. For example, the ball sealers may be used to plug the perforations in a sequence basically from the bottom of the well upwards by injecting a dense fluid into the well to cause fluid flow through the perforations. The dense fluid will displace the light fluid in the bottom of the wellbore and will cause the ball sealers situated in the rathole to migrate upwardly. As the ball sealers encounter fluid flowing through the perforations, the ball sealers will be carried onto the perforations by the dense fluid. At the appropriate time, usually upon completion of stimulation, a light fluid may be introduced into the casing to reposition the balls in the rathole after the balls unseat from the perforations as described above.

It may be seen that the present invention possesses a number of advantages over procedures now used to deliver ball sealers to perforations in the casing in a wellbore. With the process of the present invention, controlled density ball sealers and injection fluids can be utilized to effect improved diversion during well stimulation without using expensive equipment and to transport ball sealers to the perforations in a manner which is independent on flow rate in the casing.

EXAMPLE 1

The following example illustrates a specific procedure for performing the method of the present invention. In this hypothetical example, a well is drilled in a carbonate formation and treated with an aqueous acidizing solution to stimulate oil production. A 3,060 foot well is completed, generally as shown in FIG. 1, with 6-inch casing through an oil producing formation. A packer is run into the casing on $2\frac{3}{8}$ inch production tubing and set at the 3,000 foot level. A perforated interval located at the 3,025–3,050 foot level contains 50 holes.

The well is to be acidized with 28% hydrochloric acid (HCl) having an approximate density of 1.14 g/cc. The maximum allowable flow rate of the acid solution down the production tubing for matrix acidization treatment of this formation is determined to be 0.5 barrels per minute (BPM). Injection rates above 0.5 BPM may fracture the formation.

Ball sealers having a $\frac{7}{8}$-inch diameter and having a density of 1.10 g/cc are used to restrict fluid flow through the perforations having the least resistance to fluid flow. The rising velocity of ball sealers in 28% HCl is determined to be about 30 feet per minute. In order for the 28% HCl to carry the balls down the production casing, the flow rate should be at least 0.86 BPM. Therefore, at matrix acidization rates, the 28% HCl will not transport the lightweight ball sealers down the production tubing to the perforations without using a displacement technique such as provided by this invention.

The practice of this invention may be carried out in accordance with the following sequence of steps:

1. Inject a 1.2 g/cc aqueous brine containing a NaCl—$CaCl_2$ mixture;
2. Inject 30 barrels of the 28% HCl (1.14 g/cc) into the production tubing;
3. Inject 6 barrels of 2% potassium chloride (KCl) brine having a density of 1.02 g/cc and containing 25 ball sealers (1.10 g/cc);
4. Inject 30 barrels of 28% HCl into the casing; and 5. Inject field crude oil into the casing to displace the HCl, KCl, NaCl—$CaCl_2$ solution and ball sealers down the casing to the perforations.

By practicing the above procedure, the ball sealers will tend to sink in the KCl brine, but float in the 28% HCl. In this fashion the balls will accumulate at the interface or transition zone separating the 28% HCl (Step 2) and the KCl brine (Step 3) and be transported to the bottom of the well with that interface independently of the overall fluid velocity. The balls will seat onto 25 perforations through which fluids are flowing. The remaining 25 perforations remain open for fluid flow and are treated with the 30 BBLS of 28% HCl injected during Step 4. The treatment is displaced using sufficient field crude to overdisplace all acid into the formation leaving the wellbore filled with the light field crude. As a result, upon completion of the above procedure, and upon relieving the differential pressure across the perforations, the ball sealers sink to the rathole. With the ball sealers in this location, the likelihood of producing ball sealers with the formation fluids is minimized.

EXAMPLE 2

The following field test illustrates another specific procedure for performing the method of the present invention. The test described in this example was performed in a well drilled to a depth of 15,608 feet. The lower portion of the well was completed with 7-inch casing through an oil producing formation. A packer was run inside the casing on 3½ inch tubing and set at the 15,020 foot level. The well contained 568 perforations distributed over 5 zones as set forth in Table 1.

TABLE 1

| Zone | Depth (feet) | Perforations |
|---|---|---|
| 1 | 15161–15192 | 128 |
| 2 | 15235–15245 | 80 |
| 3 | 15286–15298 | 96 |
| 4 | 15345–15366 | 168 |
| 5 | 15406–15418 | 96 |

In accordance with this invention, a diversion procedure was designed using ball sealers and fluids having controlled densities. Densities were chosen such that the ball sealers would be less dense than portions of the treating fluid and would be more dense than those fluids subsequently injected during waterflood operations. By this method 100% seating efficiency was anticipated during the treatment and the ball sealers would sink to the rathole during subsequent injection of waterflood fluids.

The practice of the invention was carried out in accordance with the procedure as summarized below:

(1) 100 barrels (BBLS) of water were pumped into the well at a rate of approximately 10 barrels per minute (BPM) to check pump equipment and to establish injectivity into the formation.

(2) 120 BBLS of brine having a density of 1.18 g/cm$^3$ and containing 120 lightweight ball sealers (1.11–1.13 g/cm$^3$ density) were introduced in an attempt to seal off 120 perforations in the upper, high permeability zones prior to the injection of acid-stimulation fluids.

(3) 320 BBLS of hydrochloric acid (HCl) consisting of stages of 15% HCl and 28% HCl, were injected containing 280 ball sealers injected at a rate of 1–2 balls per barrel of fluid. Three of the 28% HCl stages were tagged with radioactive sand having radioactivity of 5 millicuries.

(4) 180 BBLS of fresh water were introduced to overdisplace the treating fluids and radioactive sand into the formation.

(5) Injection was ceased and the pressure was allowed to decrease which permitted the ball to unseat from the perforations and sink to the rathole.

Several pressure increases were observed at the surface during injection of the acid solutions. These pressure increases were attributed to balls seating on perforations. Soon after each pressure increase a corresponding pressure decrease was observed which was attributed to a breakdown of a zone to acceptance of injection fluid.

A radioactivity measuring device was run in the casing after the stimulation procedure to record the location of radioactivity in the casing and hence the location of the radioactive sand. Radioactivity was detected in the vicinity of each of the five zones which indicated fluid had penetrated all of the zones.

Figure 3:
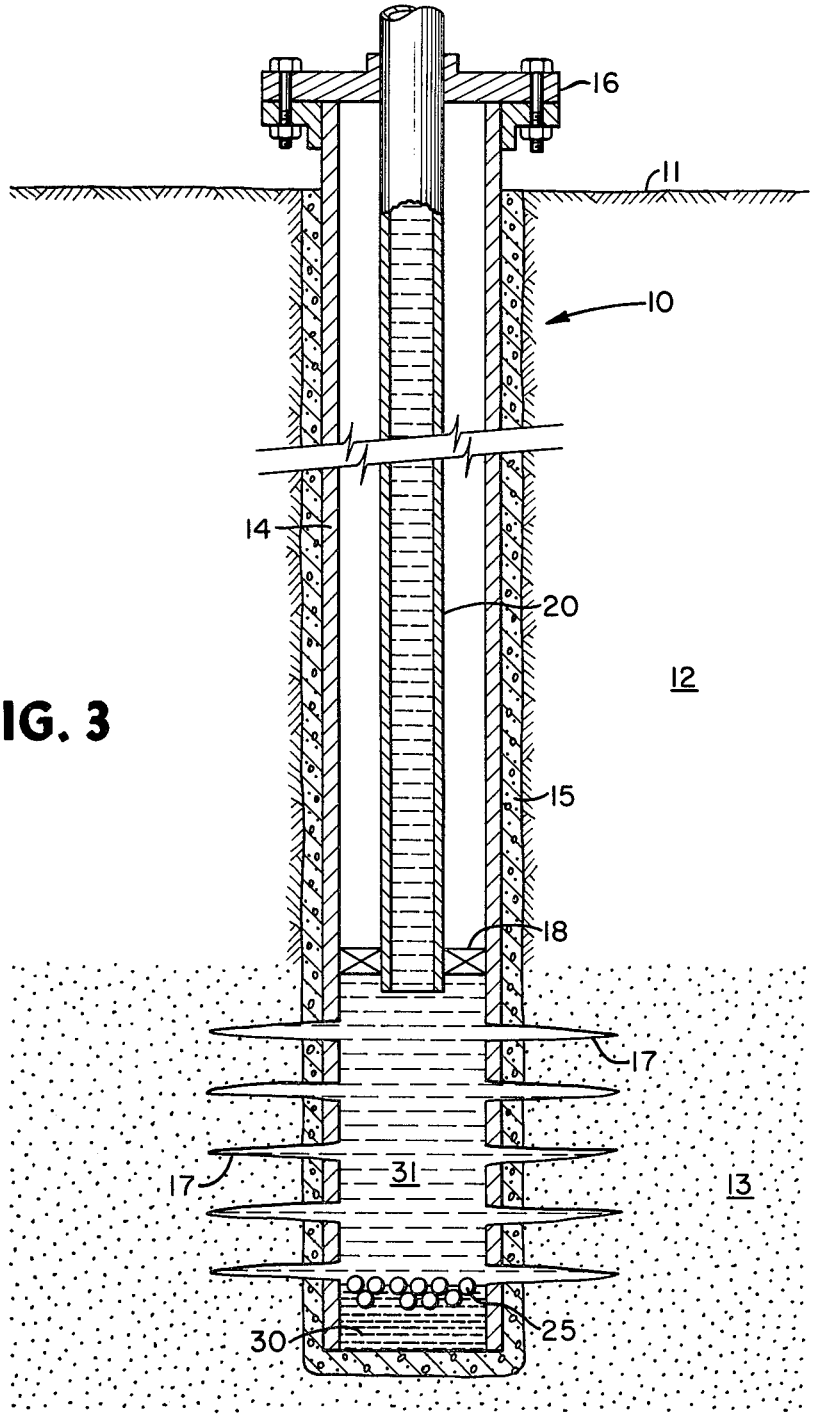
FIG. 3 is an illustration view in section of a well illustrating the position of ball sealers at the completion of a treatment carrier out in accordance with one embodiment of this invention.

Upon resuming the waterflood operation, surface monitored injection rates and pressures indicated that the ball sealers had unseated from the perforations and had migrated to the rathole as indicated generally by FIG. 3.

The principle of this invention and the best mode in which it is contemplated to apply that principle has been described. It is to be understood that the foregoing is illustrative only and that other means and techniques can be employed without departing from the true scope of the invention defined in the claims.

We claim:

1. A method for plugging at least one perforation in a well case having a plurality of perforations comprising introducing into said casing a plurality of ball sealers sized to restrict flow through at least one of said perforations;

introducing into said casing a first fluid having a density greater than the density of said ball sealers;

after introduction of the first fluid, introducing into the casing a second fluid having a density no greater than the the density of said ball sealers density; and transporting at least some of said ball sealers down the casing at the transition region between said first and second fluid.

2. The method as defined in claim 1 further comprising displacing second fluid with a displacing fluid.

3. The method as defined in claim 4 wherein said displacing fluid has a density greater than the density of said ball sealers.

4. The method as defined in claim 4 wherein said first and said displacing fluids are formation treating fluids.

5. The method as defined in claim 4 wherein the displacing fluid is an acid solution.

6. The method as defined in claim 4 wherein the displacing fluid has a density greater than the ball sealer density.

7. The method as defined in claim 4 wherein the first fluid is the same as the displacing fluid.

8. The method as defined in claim 4 wherein the displacing fluid is the same as the second fluid.

9. The method as defined in claim 4 wherein the second fluid is miscible with said displacing fluid.

10. The method as defined in claim 4 wherein said displacing fluid is a treating fluid.

11. The method as defined in claim 1 wherein said second fluid has essentially the same density as the density of the ball sealers.

12. The method as defined in claim 1 wherein said second fluid has a density less than the density of said ball sealers.

13. The method as defined in claim 1 wherein the first fluid is a brine solution.

14. The method as defined in claim 1 wherein the second fluid is diesel oil.

15. The method as defined in claim 1 wherein the first fluid has a density of at least 0.03 g/cc greater than said ball sealer density and the second fluid has a density at least 0.03 g/cc less than the ball sealer density.

16. The method as defined in claim 1 wherein said ball sealers introduced concurrently with said first fluid.

17. The method as defined in claim 4, wherein the ball sealers and the second fluid are introduced into the casing concurrently.

18. The method as defined in claim 1 wherein said first and second fluid are immiscible and said transition region is an interface.

19. A method for plugging at least one perforation in a well casing having a plurality of perforations comprising;

introducing into said casing a plurality of ball sealers sized to restrict flow through at least one of said perforations;

introducing into said casing a first fluid having a density greater than the density of said ball sealers;

after introduction of the first fluid, introducing into the casing a second fluid having a density no greater than the the density of said ball sealers; and transporting at least some of said ball sealers down the casing in the trailing portion of said first fluid and the leading portion of said second fluid.

20. A method for treating a subterranean formation surrounding a cased wellbore, wherein ball sealers are used to plug perforations formed in the well casing opposite said formation, the improvement which comprises placing said ball sealers suspended in a fluid having a density less than said ball sealers in said well at a location below said perforations opposite said formation, and thereafter injecting a fluid having a density greater than said ball sealers into said formation at a rate such that the ball sealers rise in said fluid and are carried onto said perforations.

* * * * *

UNITED STATES PATENT AND TRADEMARK OFFICE

CERTIFICATE OF CORRECTION

PATENT NO. : 4,195,690

DATED : April 1, 1980

INVENTOR(S) : Erbstoesser et al.

It is certified that error appears in the above—identified patent and that said Letters Patent is hereby corrected as shown below:

In the claims, at column 10, line 51, that portion reading "claim 4" should read --claim 2--;

At column 10, line 54, that portion reading "claim 4" should read --claim 2--.

Signed and Sealed this

*Ninth* Day of *September 1980*

[SEAL]

*Attest:*

SIDNEY A. DIAMOND

*Attesting Officer*

*Commissioner of Patents and Trademarks*